US006834481B1

(12) United States Patent
Huang

(10) Patent No.: US 6,834,481 B1
(45) Date of Patent: Dec. 28, 2004

(54) DOUBLE SLEEVE SHRINKABLE LABEL INSERTING MACHINE

(76) Inventor: Nan-Yuan Huang, 3F, No. 21, Lane 22, Nanjung St., Hsinchu (TW)

( * ) Notice: Subject to any disclaimer, the term of this patent is extended or adjusted under 35 U.S.C. 154(b) by 0 days.

(21) Appl. No.: 10/664,167

(22) Filed: Sep. 17, 2003

(51) Int. Cl.[7] ..... B65B 53/02; B65B 59/00
(52) U.S. Cl. ..... 53/557; 53/48.2; 53/585
(58) Field of Search ..... 53/557, 442, 585, 53/582, 201, 291, 296, 48.2; 156/DIG. 15

(56) References Cited

U.S. PATENT DOCUMENTS 3,023,554 A * 3/1962 Hlavacek et al. ..... 53/585
3,974,628 A * 8/1976 Konstantin ..... 53/557
4,922,683 A * 5/1990 Connolly ..... 53/585
5,566,527 A * 10/1996 Drewitz ..... 53/585
5,737,900 A * 4/1998 Konstantin et al. ..... 53/585
6,070,399 A * 6/2000 Huang et al. ..... 53/585
6,223,499 B1 * 5/2001 Wilkey ..... 53/442
6,684,599 B1 * 2/2004 Fresnel ..... 53/585

* cited by examiner

*Primary Examiner*—Stephen F. Gerrity
(74) *Attorney, Agent, or Firm*—Birch, Stewart, Kolasch & Birch, LLP

(57) ABSTRACT

A double sleeve shrinkable label inserting machine includes a station, a shrink film conveying device, a guiding device, a cutter device, a tuning device, a thermosetting device and two rotary wheels. The guiding device and cutter device may be adjusted rapidly according to the shape and size of two identical or different package goods to wrap a shrink film sleeve on the package goods, and the thermosetting device can bond the shrink film sleeve neatly to the package goods.

5 Claims, 12 Drawing Sheets

DOUBLE SLEEVE SHRINKABLE LABEL INSERTING MACHINE

FIELD OF THE INVENTION

The present invention relates to a double sleeve shrinkable label inserting machine and particularly to a double sleeve shrinkable label inserting machine for wrapping two identical or different package goods at high speed with simple operation and improved quality.

BACKGROUND OF THE INVENTION

The conventional double sleeve shrinkable label inserting machine generally comprises a shrink film sleeve with a first end bonding to one side of the entire shrink film sleeve and a second end bonding to the outer side of the first end, or the other side of the second end is bonded to another side of the entire shrink film sleeve to make the first end and the second end spacing from each other to form a dividing wall of a selected length, so that the shrink film sleeve forms two housing spaces of the same size or different sizes. In such an approach the amount of bonding glue is difficult to control, hence the shrink film sleeve easily peels off. Moreover, the glue contains moisture which is prone to lose adhering power when in contact with liquid. In addition, the bonding approach not only wastes time and affects operation efficiency, product quality also is unstable, and the shrink film sleeve wrapped on the goods are easily skewed during conveying. This affects the appearance of the shrink-wrapped goods, and results in increase of defect rate, and quality of mass production is serious impacted.

SUMMARY OF THE INVENTION

In view of the aforesaid disadvantages, Applicant has proposed an improved shrink film sleeve for packaging use. The proposal teaches how to make a shrink film sleeve to form two housing spaces of the same or different sizes. However, the machine and operation required to drive, convey and package are not included.

In order to remedy the problems set forth above, the invention aims at providing a double sleeve shrinkable label inserting machine that can rapidly adjust a guiding device and a cutter device according to the form and size of the goods to be packaged to match different types of goods and to achieve fast production speed with simple operation and improved quality. The double sleeve shrinkable label inserting machine of the invention mainly includes a station, a shrink film conveying device, a guiding device, a cutter device, a tuning device, a thermosetting device and two rotary wheels. The shrink film conveying device transports a shrink film sleeve to first center struts on the upper side of the guiding device. There are conveying roller sets and corresponding rollers to move the shrink film sleeve to second center struts at the lower side of the guiding device that are corresponding to the first center struts. Then the cutter device between the first and second center struts cuts off the shrink film sleeve. The cutoff shrink film sleeve is moved downwards, and through another conveying roller set and rollers to wrap the shrink film sleeve on the entire packing goods. Then the goods are transferred to the thermosetting device for shrinking process to enable the shrink film sleeve to tightly bond to the goods.

Therefore the primary object of the invention is to provide a double sleeve shrinkable label inserting machine to wrap two identical or different package goods at fast production speed with simple operation and improved quality.

Another object of the invention is to provide a manual tuning device to adjust the distance between the rollers and conveying roller sets.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 4A:
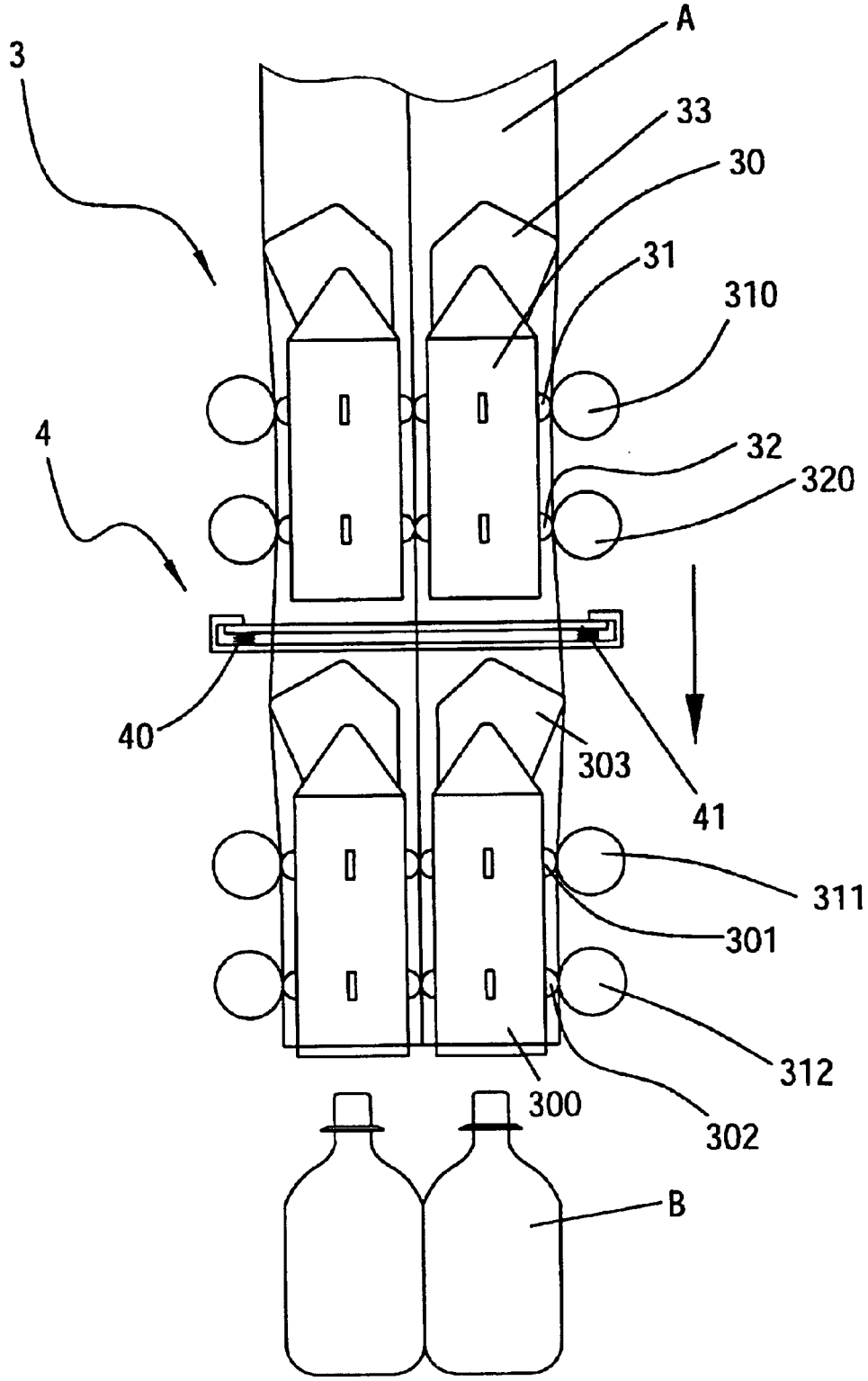
FIG. 4A is a schematic view of the guiding device in an operating condition.
Figure 4B:
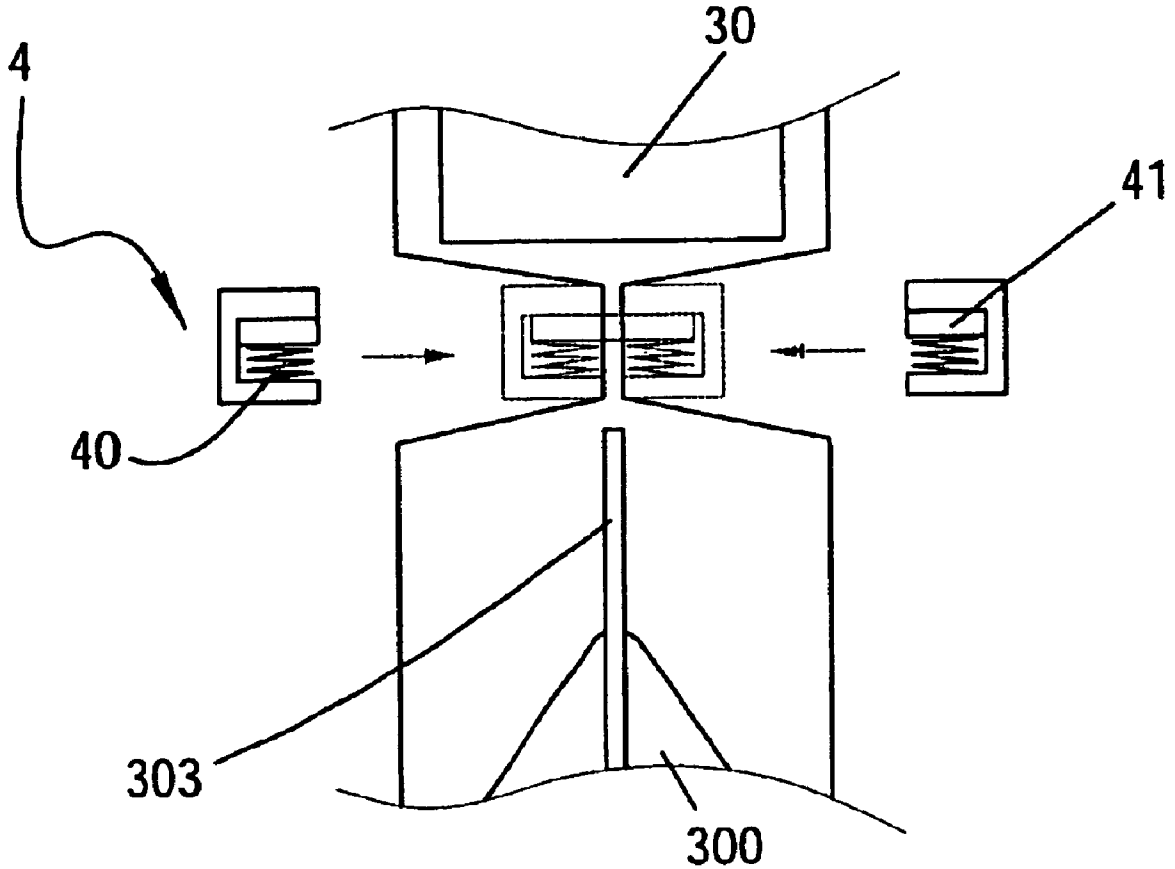
FIG. 4B is a schematic view of the cutter device in an operating condition for cutting off the shrink film sleeve.
Figure 4C:
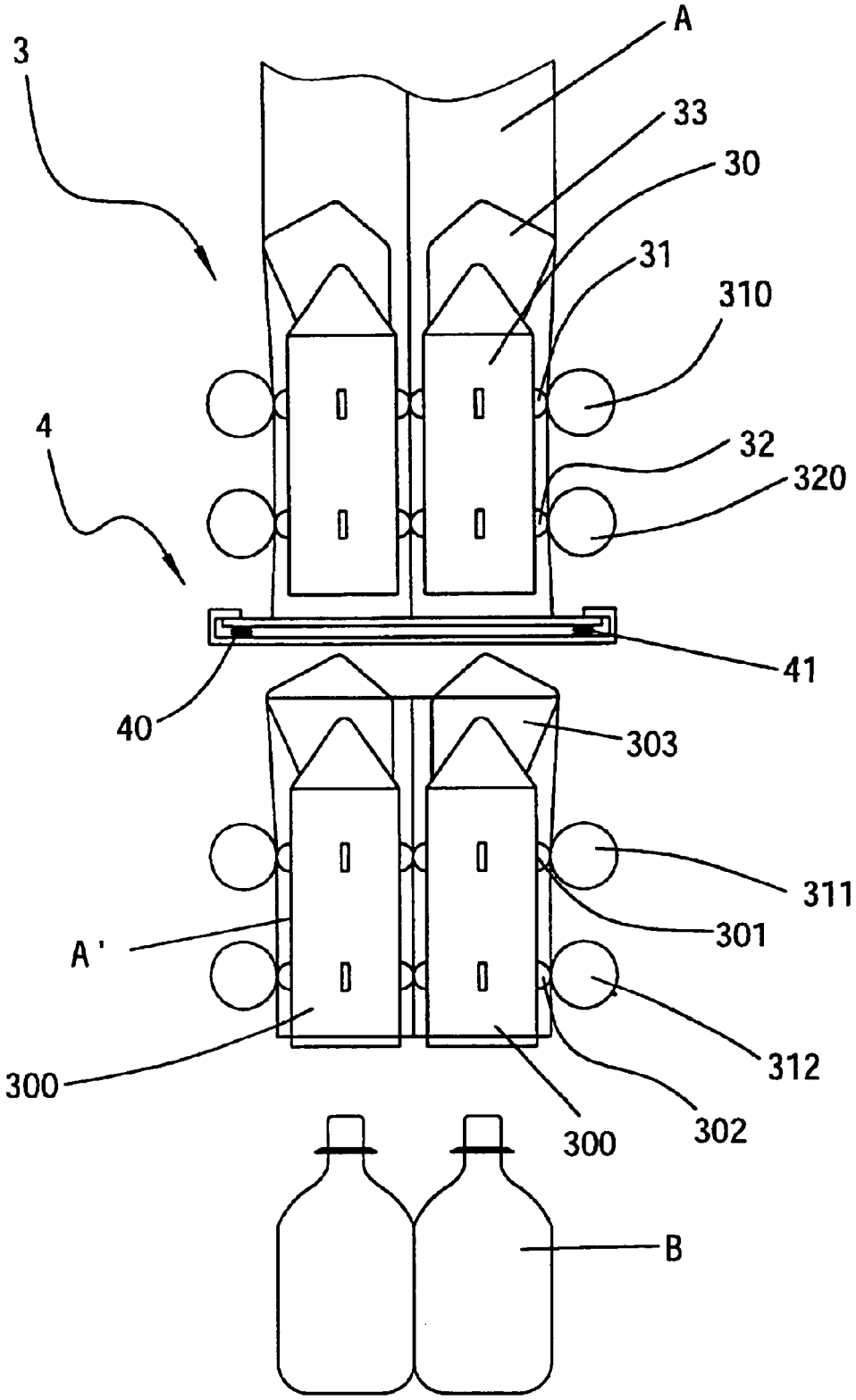
FIG. 4C is a schematic view of the guiding device in an operating condition for moving the shrink film sleeve.
Figure 5:
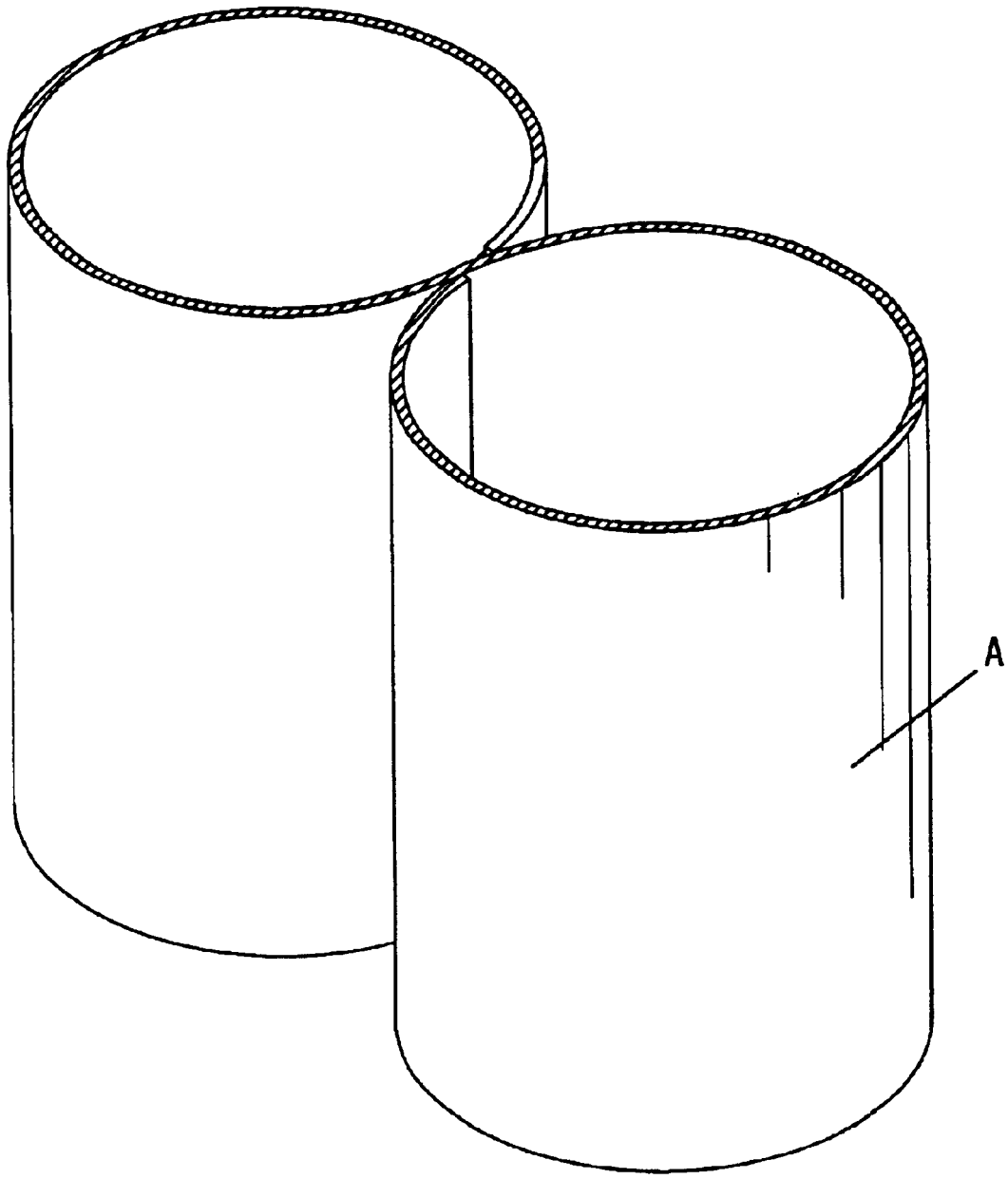
FIG. 5 is a perspective view of a shrink film sleeve.
Figure 6:
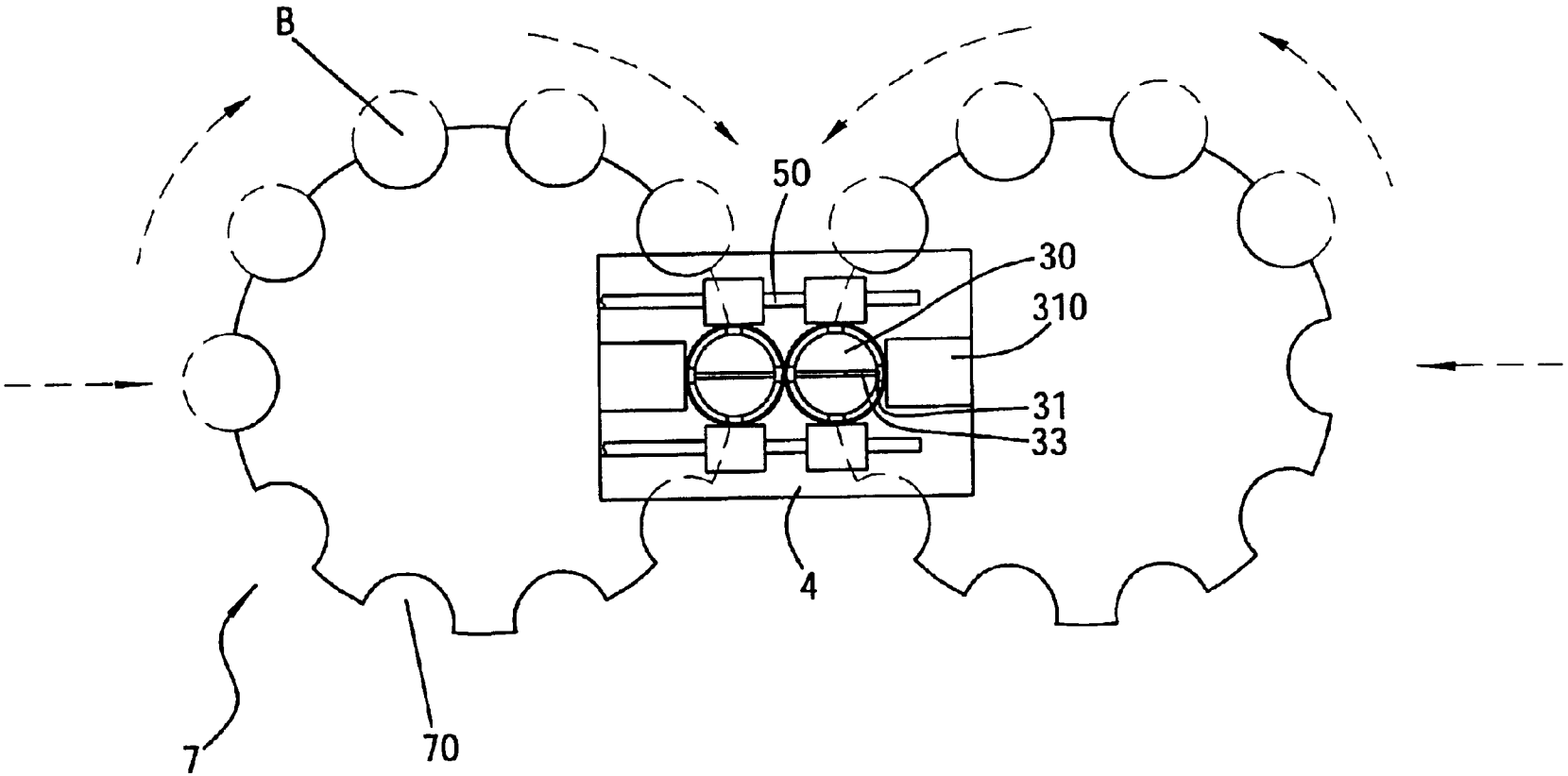
FIG. 6 is a schematic view of the packaged goods being transferred.
Figure 7:
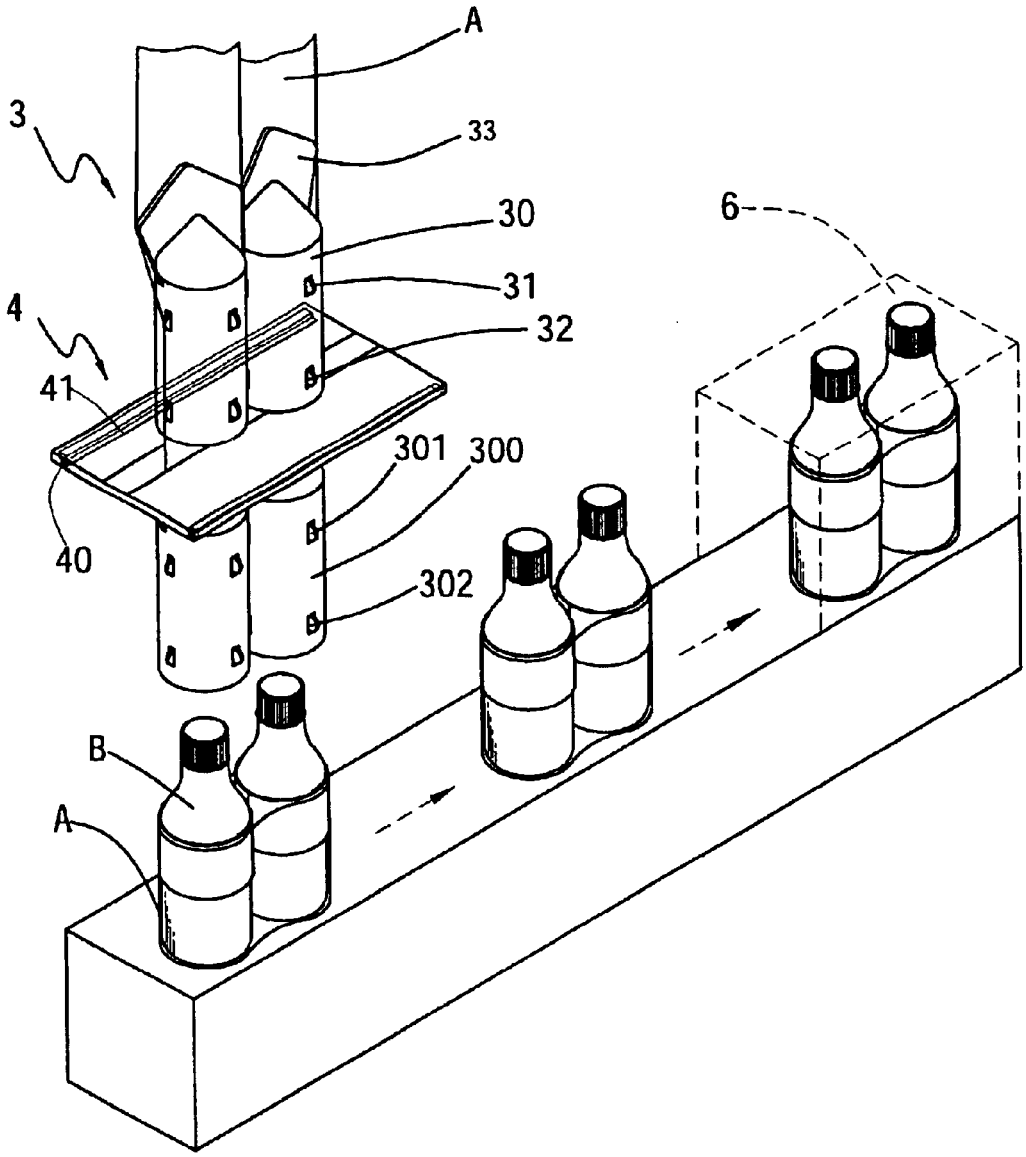
FIG. 7 is a schematic view of the packaged goods being transferred to the thermosetting device.

Referring to FIGS. 1, 2, 3 and 7, the double sleeve shrinkable label inserting machine of the invention includes a station 1, a shrink film conveying device 2, a guiding device 3, a cutter device 4, a tuning device 5, a thermosetting device 6 and two rotary wheels 7. The shrink film conveying device 2 transfers a shrink film sleeve A to a set of first center struts 30 on the upper side of the guiding device 3. The first center struts 30 have first conveying roller sets 31 and 32 to move the shrink film sleeve A to second center struts 300 located at a lower side (referring to FIGS. 3 and 4A). The cutter device 4 is located between the first and second center struts 30 and 300 to clamp the shrink film sleeve (as shown in FIG. 4B) and, cut off the shrink film sleeve A through cutter 41 (referring to FIG. 4C). The cutoff shrink film sleeve A' is moved downwards and formed a into a figure-8 shaped shrink film sleeve A by second conveying roller sets 301 and 302 located on the second center struts 300 (as shown in FIG. 5). Then the shrink film sleeve A drops to the rotary wheels 7 (as shown in FIG. 6) on an inner side of a conveying path to wrap package goods B from outer side. The wrapped package goods B are transported to the thermosetting device 6 in which the shrink film sleeve A is shrunk by heated air to tightly bond to the package goods B (referring to FIG. 7).

On one side of the station 1, there is a shrink film holding wheel 10 to hold a reel of folded shrink film sleeve A. The film conveying device 2 is located above the shrink film holding wheel 10 to convey the shrink film sleeve A to the guiding device 3.

The film conveying device 2 includes a holding rack 20 which holds a plurality of roller axles 21, 22 and 23. The roller axles 21, 22 and 23 may transmit the shrink film sleeve A to the center struts 30 and 300 of the guiding device 3.

Figure 1:
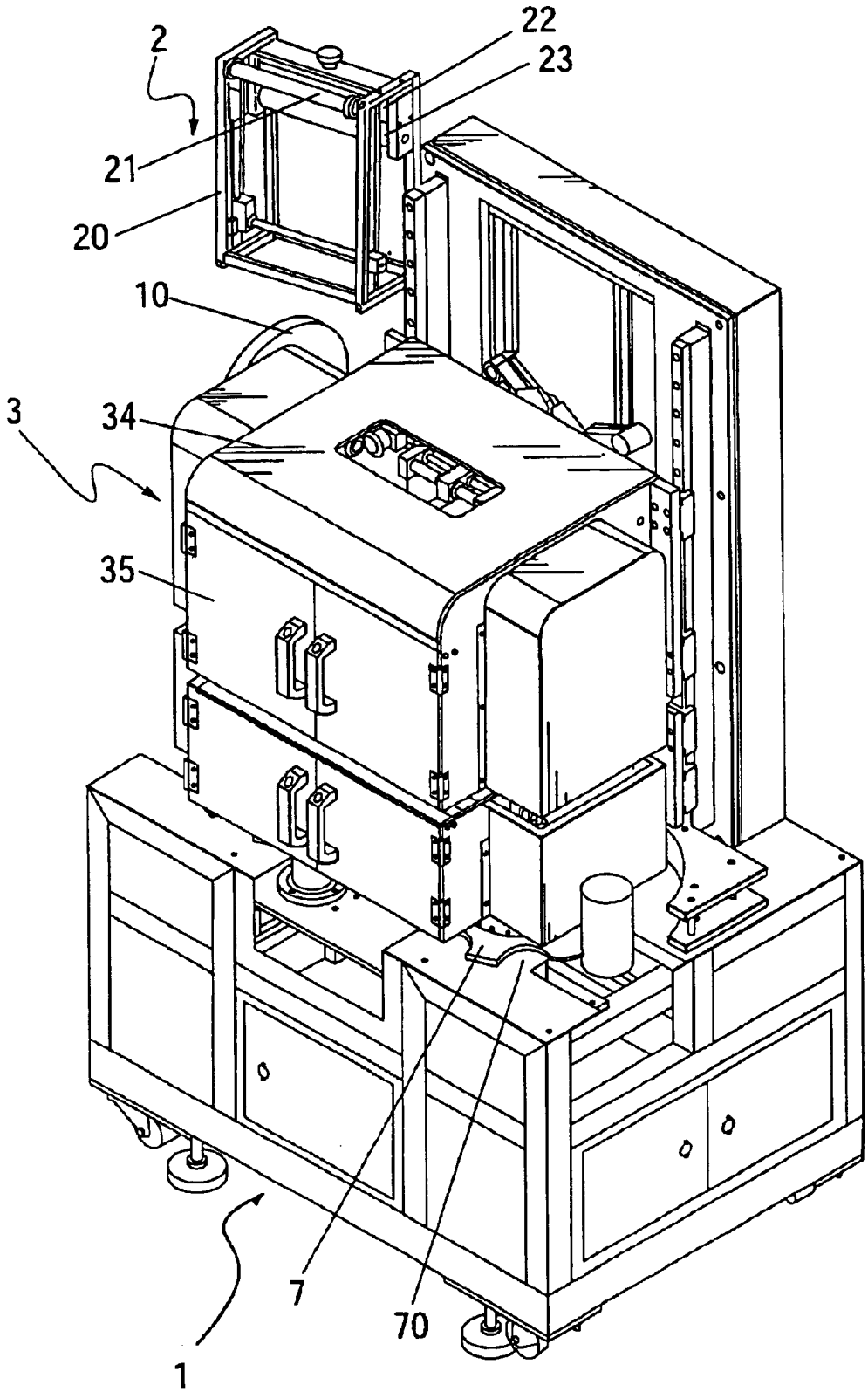
FIG. 1 is a perspective view of the present invention.
Figure 2:
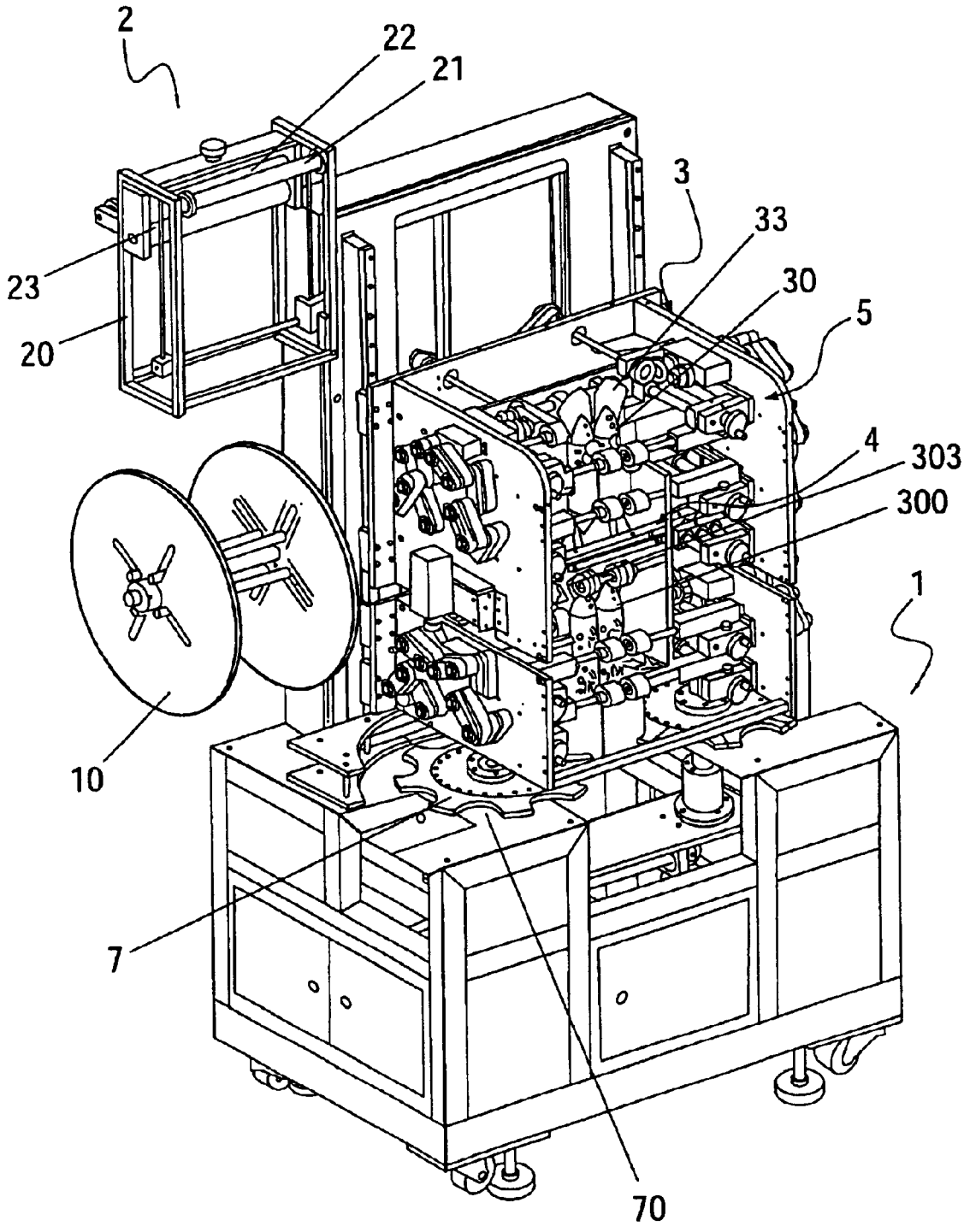
FIG. 2 is a perspective view of the present invention with the upper lid and door panels removed.
Figure 3:
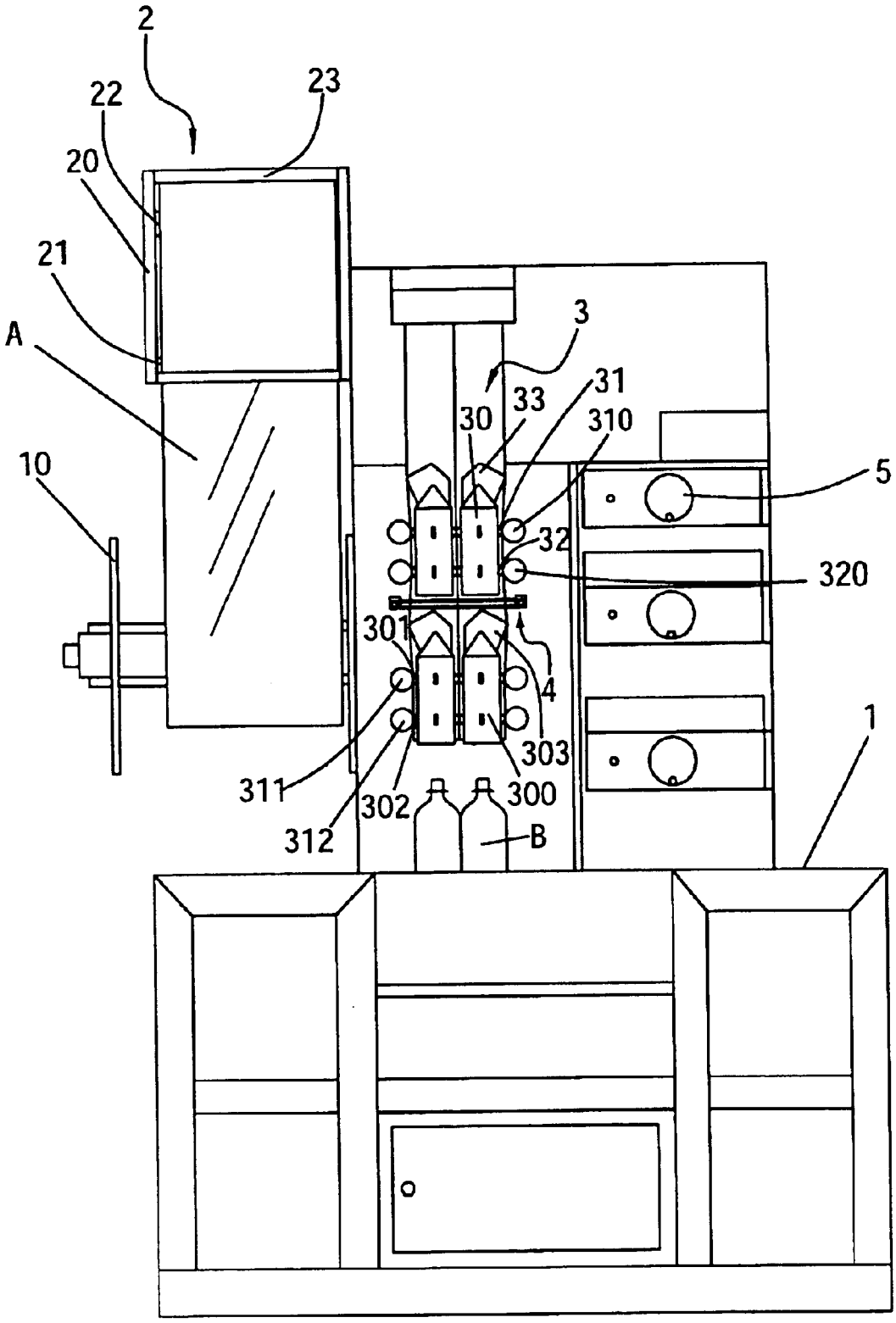
FIG. 3 is a front view of the present invention.

The guiding device 3 is located above the station 1 (as shown in FIG. 3). It mainly includes two sets of center struts 30 and 300 that have respectively anchor plates 33 and 303 mounted on the top end. On the upper, middle and lower peripheral sides of the center struts 30 and 300, there are the conveying roller sets 31, 32, 301 and 302. And there are rollers 310, 320, 311 and 312 corresponding to the conveying roller sets 31, 32, 301 and 302. The rollers 310, 320, 311 and 312 are coupled with tuning axles 50 of the tuning device 5. In addition, the guiding device 3 is covered by an upper lid 34 on the top and door panels 35 at the front side to protect the mechanisms of the guiding device 3 from being damaged.

The cutter device 4 is a rectangular member located between the center struts 30 and 300. It has two sides containing respectively an elastic element 40. There is a cutter 41 mounted on the elastic element 40.

Figure 9A:
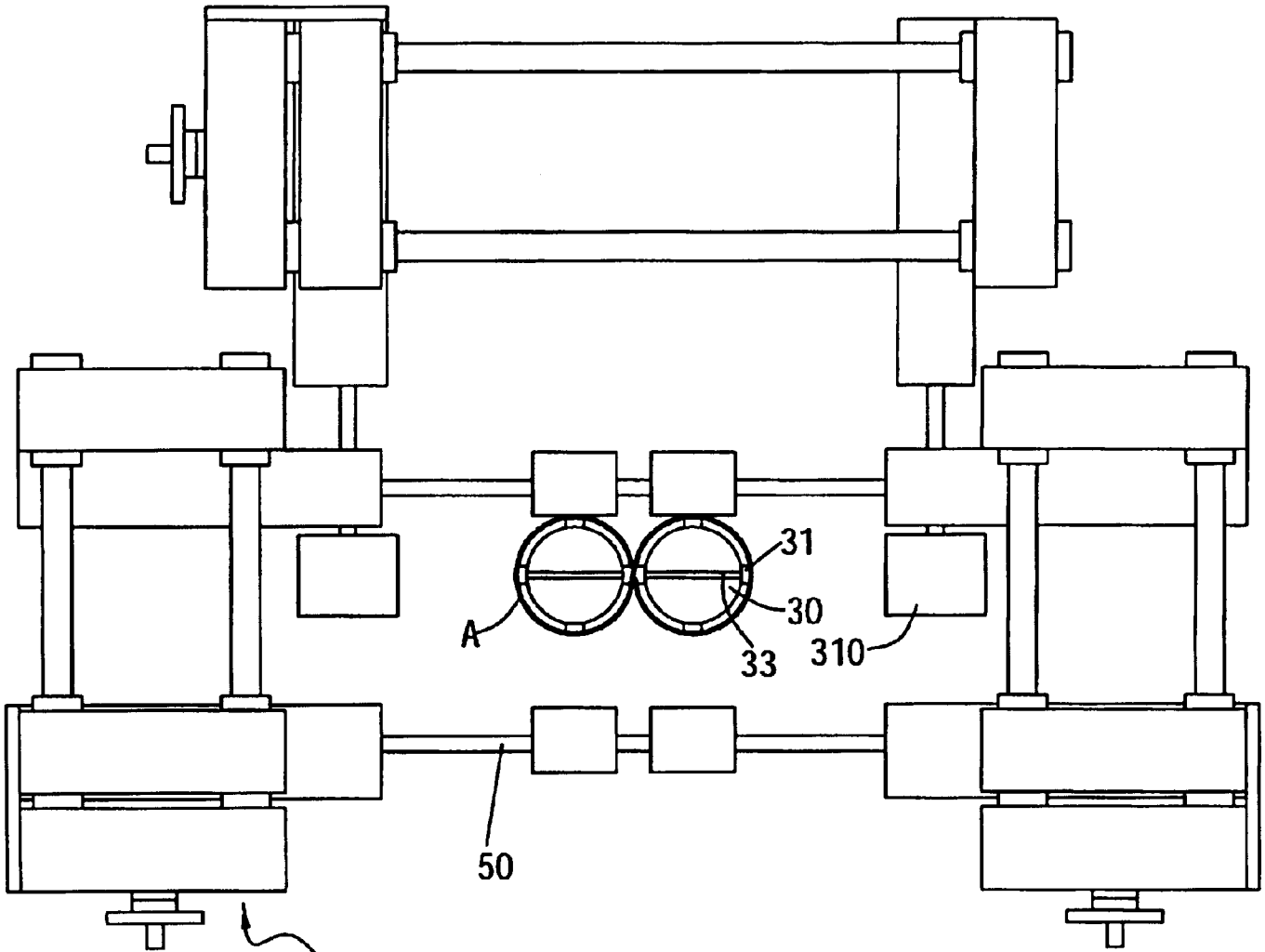
FIG. 9A is a top view of the tuning device.
Figure 9B:
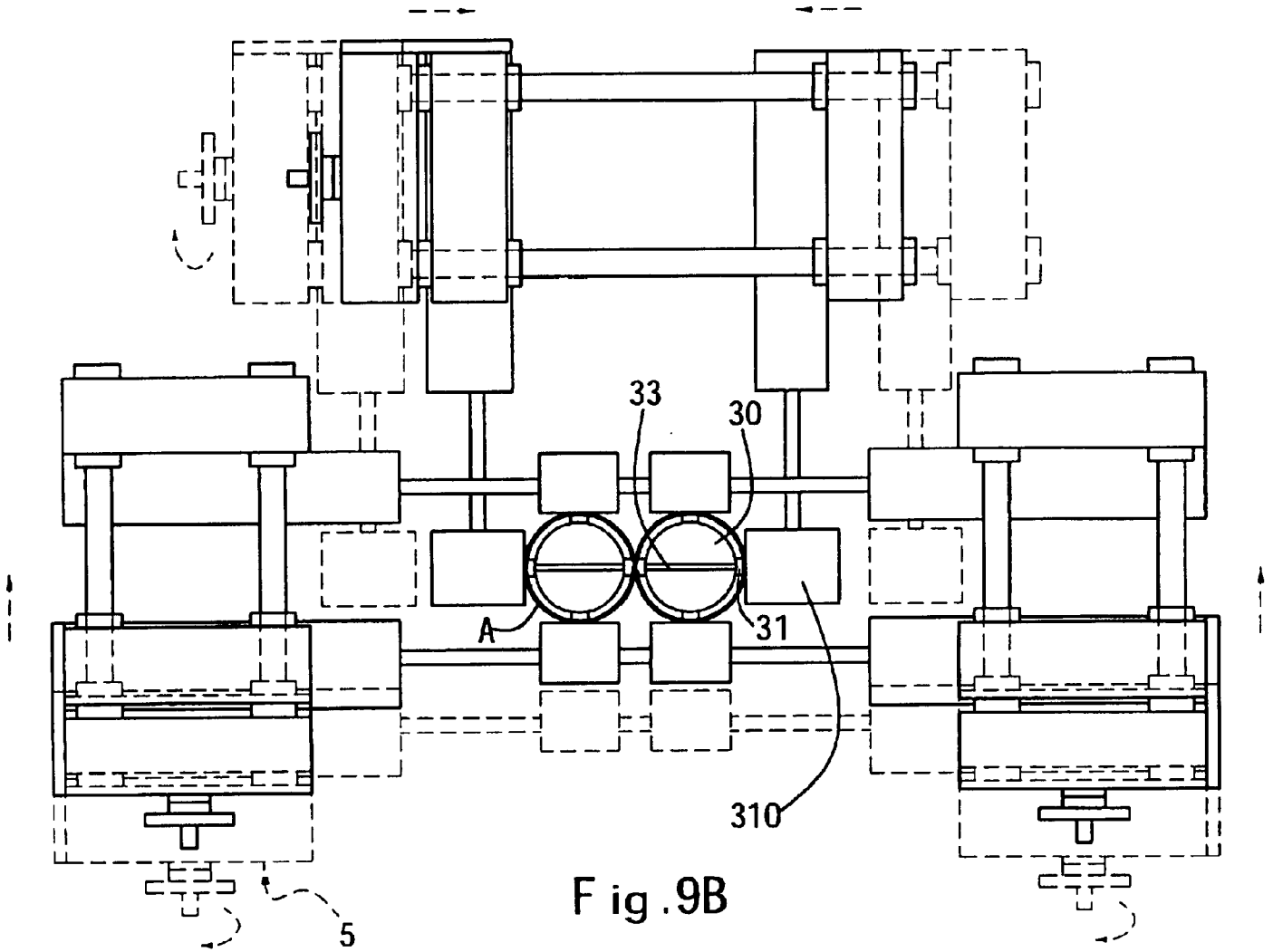
FIG. 9B is a schematic view of the tuning device for adjusting up and down, and left and right.

The tuning device 5 is operable manually. It has tuning axles 50 to couple with the rollers 310, 320, 311 and 312 of the guiding device 3 (as shown in FIGS. 9A and 9B).

The thermosetting device 6 is located on one side of the station. It aims to tightly bond the shrink film sleeve A on the package goods B (referring to FIG. 7).

The rotary wheel 7 is circular and has a plurality of arched notches 70 formed on desired locations to match the package goods (referring to FIG. 6).

During operation, the shrink film sleeve A is conveyed from the holding wheel 10 to the shrink film conveying device 2, and channeled by the holding roller shafts 21, 22 and 23, then conveyed to the guiding device 3. The first roller sets 31 and 32 move the shrink film sleeve A to the first center struts 30. Then the shrink film sleeve A is moved to the second center struts 300 through the first conveying roller sets 31 and 32, and the first rollers 310 and 320 (as shown in FIG. 4A). When the shrink film sleeve A is stretched between the first and second center struts 30 and 300, the cutter 4 clamps the shrink film sleeve A (referring to FIG. 4B), and the cutters 41 are moved horizontally to the center to cut off the shrink film sleeve A (referring to FIG. 4C). The cutoff shrink film sleeve A' is moved downwards and transformed by the second conveying roller sets 301 and 302, and the corresponding second rollers 311 and 312 to a into a figure-8 shaped shrink film sleeve A (as shown in FIG. 5) which is transported to the packing goods B on the rotary wheels 7 (as shown in FIG. 6) for wrapping the entire package goods B. Then the wrapped package goods B are transported to the thermosetting device 6 which has heated air to shrink and bond the shrink film sleeve A tightly on the package goods B (referring to FIG. 7).

Figure 8:
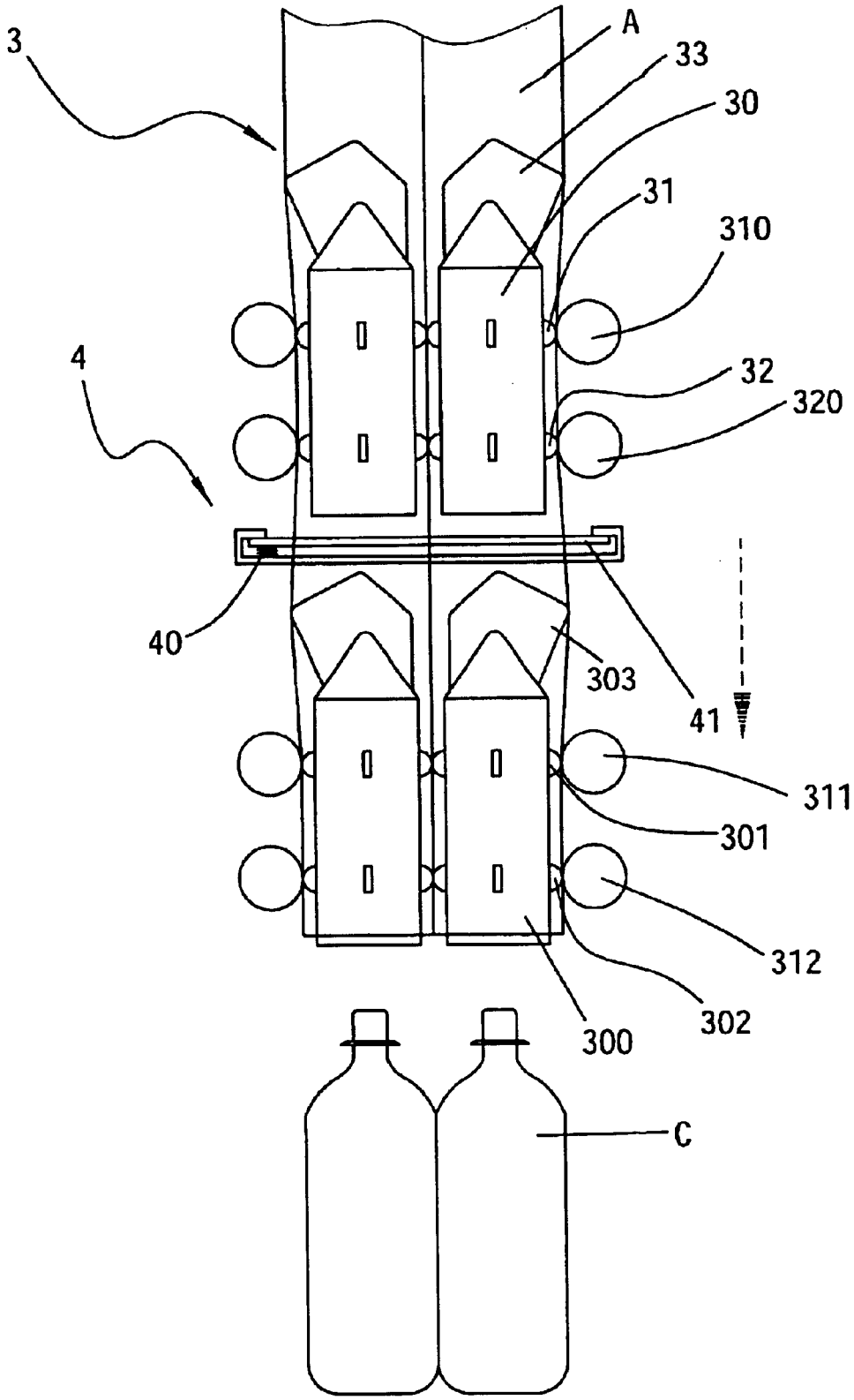
FIG. 8 is a schematic view of the guiding device transporting package goods of a different height.

Referring to FIG. 8, when the size of the package goods C increases, the elevation of the center struts 30 and 300 may be adjusted according to the size of the package goods C.

In the event that the distance between the rollers 310, 320, 311 and 312 and the conveying roller sets 31, 32, 301 and 302 is too large or too small, the tuning axles 50 of the tuning device 5 may be moved to adjust the distance between the rollers 310, 320, 311 and 312 and the conveying roller sets 31, 32, 301 and 302 (referring to FIGS. 9A and 9B).

What is claimed is:

1. A double sleeve shrinkable label inserting machine, comprising:

a station having one side mounting a thermosetting device and another side mounting a shrink film holding wheel;

a film conveying device having a holding rack to hold a plurality of roller axles;

a guiding device located below the roller axles including two sets of center struts each having an anchor plate located on the top thereof and conveying roller sets located on an upper side, a middle side and a lower side of the periphery thereof, and rollers corresponding to the conveying roller sets;

a cutter device located between the two sets of center struts and formed in a rectangular member which has two sides containing respectively an elastic element, the elastic element being coupled with a cutter;

a tuning device having tuning axles to couple with the rollers of the guiding device; and two circular rotary wheels located below the guiding device having equally spaced arched notches of the same shape on the top side thereof;

wherein the rotary wheels are rotated in opposite directions to carry two identical or different package goods that have been wrapped by a shrink film sleeve conveyed by the guiding device and cut off by the cutter device.

2. The double sleeve shrinkable label inserting machine of claim 1, wherein the distance between the rollers and the conveying roller sets is adjustable by the tuning device.

3. The double sleeve shrinkable label inserting machine of claim 1, wherein the conveying roller sets on the periphery of the center struts and the rollers are rotated correspondingly to move into the shrink film sleeve.

4. The double sleeve shrinkable label inserting machine of claim 1, wherein the guiding device is covered by an upper lid and door panels to protect mechanisms contained therein.

5. The double sleeve shrinkable label inserting machine of claim 1, wherein the cutters of the cutter device are moved horizontally to the center to cut off the shrink film sleeve.

* * * * *